United States Patent [19]

Pearson

[11] 4,037,228

[45] July 19, 1977

[54] SYSTEM FOR AUGMENTING THE VISUAL AND RADAR CHARACTERISTICS OF AN AIRBORNE TARGET

[75] Inventor: Walter B. Pearson, Birmingham, Ala.

[73] Assignee: Hayes International Corporation, Birmingham, Ala.

[21] Appl. No.: 678,615

[22] Filed: Apr. 20, 1976

[51] Int. Cl.[2] ..... H01Q 15/18

[52] U.S. Cl. ..... 343/18 C; 273/105.3; 273/105.4; 343/6 R; 343/18 D

[58] Field of Search ..... 343/18 C, 18 D, 6 R; 273/105.3, 105.4

[56] References Cited

U.S. PATENT DOCUMENTS

| | | | |
|---|---|---|---|
| 2,780,806 | 2/1957 | Alstyne | 343/18 C |
| 3,010,104 | 11/1961 | Powell | 343/18 C |
| 3,086,202 | 4/1963 | Hopper et al. | 273/105.3 |

*Primary Examiner*—S.C. Buczinski

*Attorney, Agent, or Firm*—Woodford R. Thompson, Jr.

[57] ABSTRACT

A system for augmenting the visual and radar characteristics of an airborne target wherein a light source is mounted within the confines of a target body and is adapted to emit a beam of light in at least one direction. A radar reflector is mounted within the confines of the target body forwardly of the light source, as viewed in the direction of travel of the light from the light source, with the radar reflector being substantially transparent to light and reflective to radar wavelengths.

9 Claims, 3 Drawing Figures

SYSTEM FOR AUGMENTING THE VISUAL AND RADAR CHARACTERISTICS OF AN AIRBORNE TARGET

BACKGROUND OF THE INVENTION

This invention relates to a system for augmenting the visual and radar characteristics of an airborne target and more particularly to such a system which embodies a light source mounted behind a radar reflector with the reflector itself being so constructed and arranged that it is essentially transparent to light and reflective insofar as radar wavelengths are concerned.

Heretofore in the art to which my invention relates, many systems have been proposed for augmenting the visual and radar characteristics of small airborne targets, such as towed targets. However, with such systems, it has been impossible to employ conventional components due to the blocking effect the reflector, commonly constructed of a non-transparent material, presents to the light source or vice-versa. Heretofore, this problem could only be overcome by mounting either the light source or the reflector external to the target to achieve both radar and visual coverage in a common sector. This type mounting arrangement is unsatisfactory where small targets having low aerodynamic drag are required. One system heretofore tried has consisted of an aircraft landing light mounted behind a clear plastic nose cone with the radar augmentation consisting of a traveling wave tube amplifier with receiving and transmitting antennas. The heavy weight of this system was determined to be excessive for the limited capability of the tow system used. Additionally, the target was too expensive for its intended use.

Another approach to solving the problem of providing both radar and visual augmentation in the forward aspect sector of the target was to use a constant-K lens radar reflector constructed of a clear material mounted in the nose of the target with a light source mounted at the focal point on the lens. However, focusing, heat dissipation, and light attenuation problems proved to be insurmountable from the standpoint of practical cost considerations.

A further approach to the problem was to mount a standard Luneberg lens, opaque to light, in the nose of the target and employ a light source which works through an optics link in the body of the target. The light was to be focused on a small rotating mirror housed inside a plastic bubble located on the underside of the target. However, due to the fact that the light source in such an arrangement was critical from the standpoint of point source properties and the bubble on the bottom of the target presented excessive drag, the cost of materials combined with the manhour cost for alignment of the optic system made the system too expensive. It will thus be seen that many systems heretofore proposed have been abandoned for reasons of cost and aerodynamic drag.

SUMMARY OF THE INVENTION

In accordance with my invention, I provide an inline arrangement of the light source and radar augmenter with both being completely contained within the confines of the target body. The radar reflector is mounted forwardly of the light source, as viewed in the direction of travel of the light from the light source, with the radar reflector being substantially transparent to light and reflective to radar wavelengths. That is, I provide means for enhancing the visual properties of the target and still provide a target which is reflective to radar wavelengths. Accordingly, I provide an inline radar-visual augmentation system for airborne targets without changing the basic aerodynamic shape of the target.

DESCRIPTION OF THE DRAWINGS

A system embodying features of my invention is illustrated in the accompanying drawings, forming a part of this application, in which.

DETAILED DESCRIPTION

Figure 2:
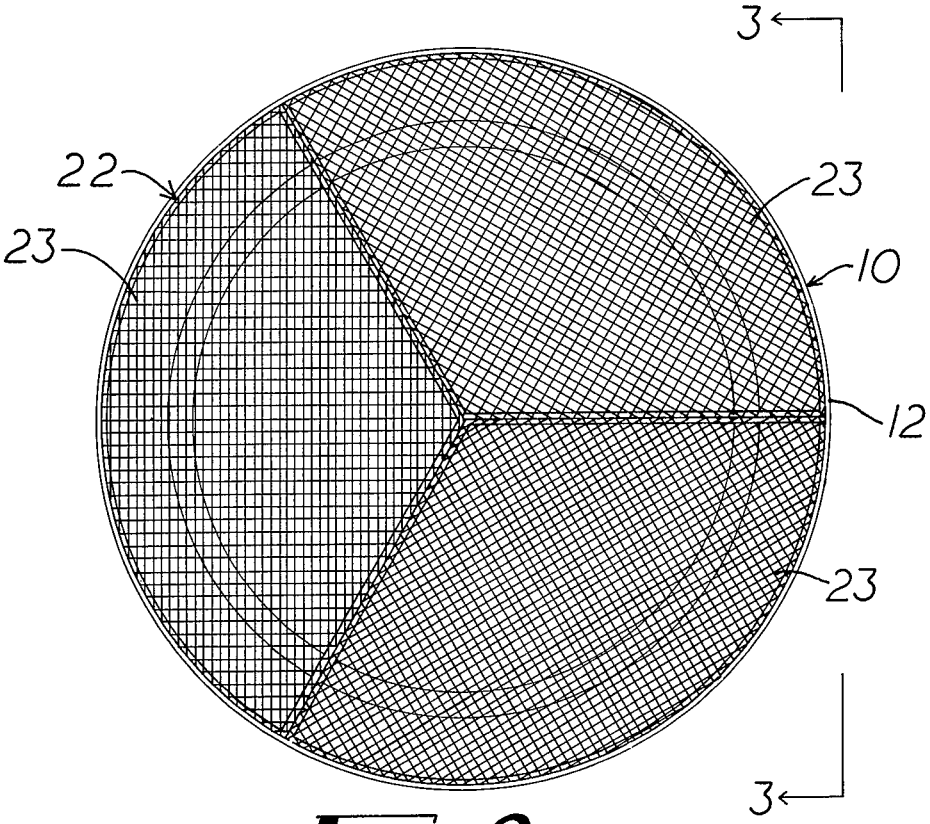
FIG. 2 is an enlarged, front elevational view taken along the line 2—2 of FIG. 1 with the nose cone removed; and, FIG. 3 is a side elevational view, partly broken away and in section, taken generally along the line 3—3 of FIG. 2 and showing the forward portion of the target.

Referring now to the drawings for a better understanding of my invention, I show an elongated target body 10 which may be cylindrical, as shown. The forward portion of the body 10 is provided with an elongated cylindrical cavity 11 defined by a cylindrical wall 12. Secured to the forward end of the cylindrical wall 12 is a nose cone 13 which is formed of a clear material which is selected for its light and radar transmission properties. Since such material is well known in the art to which my invention relates, no further description thereof is deemed necessary.

Figure 1:
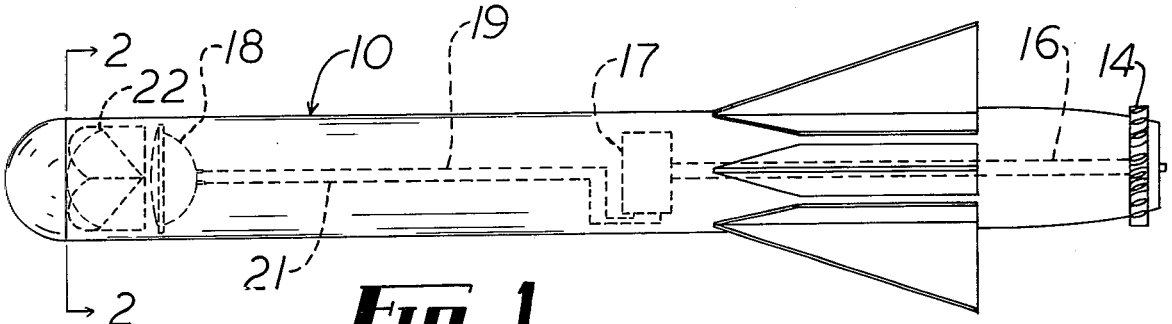
FIG. 1 is a side elevational view showing a tow target having my improved system mounted therein.
Figure 3:
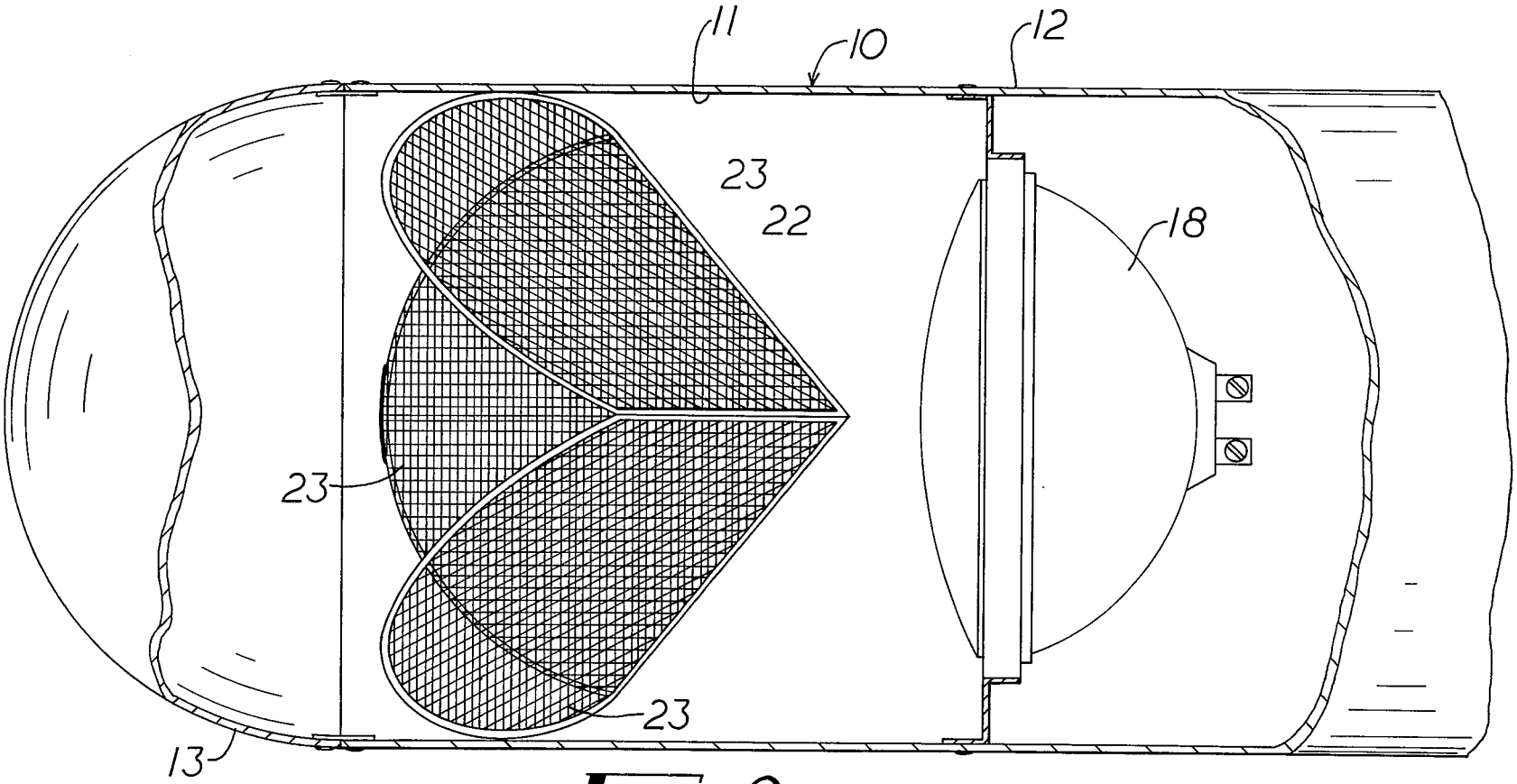

As shown in FIG. 1, a turbine unit 14 is mounted for rotation adjacent the rear end of the target body 10 on a shaft 16 which in turn is operatively connected to an electrical generating unit 17 for supplying power to a light unit 18 through lines 19 and 21. The light unit 18 may be in the form of a conventional type aircraft landing light which is secured to the inner surface of the cylindrical wall 12 by suitable means. As shown in FIGS. 1 and 3, the light 18 is mounted in position to emit a beam of light forwardly of the target body 10. That is, the beam of light is emitted toward the nose cone 13. While I have shown the light source as being in the form of a sealed beam aircraft landing light, it will be apparent that other light sources may be employed.

Mounted within the cylindrical wall 12 of the target body 10 forwardly of the light source 18 is a radar reflector indicated generally at 22. As shown in FIG. 3, the radar reflector 22 extends transversely of the forward end of the target body 10 whereby the light emitted from the light source 18 is directed onto the radar reflector. The radar reflector 22 is formed of a material which is substantially transparent to light and at the same time offers a high coefficient of reflection to radar wavelengths. In actual practice, I have found that a screen mesh material normally used for electromagnetic shielding purposes is satisfactory in every respect to transmit light therethrough and offer a high coefficient of reflection to radar wavelengths. The radar reflector 22 is attached to the cylindrical wall of the target body 10 by suitable means whereby it is mounted within the confines of the target body 10 forwardly of the light source, as viewed in the direction of travel of the light from the light source 18.

The radar reflector 22 may be in the form of a modified triangular trihedral, as shown. However, other basic geometries, such as flat plates, aximuth or elevation-only dihedral corners, square trihedrals and the like may be employed. Preferably, the reflector is in the form of a generally triangular trihedral, such as a modified triangular trihedral. A standard triangular trihedral is identical to that shown except for the extended and curved forwardly extending portions used on one side of each of three triangular panels 23 comprising the modified reflector. The standard reflector is made up of three equilateral triangles having side dimensions "a". The maximum theoretical radar cross section achieveable with a standard reflector of this geometry occurs on-axis and is found by using the following equation:

$$RCS = \frac{4\pi a^4}{3\lambda^2}$$

where

RCS = the radar cross section in square meters $a$ = the common side dimension $\lambda$ = wavelength of frequency in meters.

In the drawings, I show the standard geometry as being modified by curving and extending one side of each of the three triangular panels 23 making up the reflector 22. This modification allows utilizing the entire aperture presented by a cylindrical mounting as capture area for radar energy. Therefore, the maximum theoretical radar cross section will be somewhat greater than the standard triangular trihedral due to the large capture area; retaining the same "a" dimensions as the standard triangular trihedral, the relationship is restated in terms of an approximation:

$$RCS > \frac{4\pi a^4}{3\lambda^2}$$

The above relationships are applicable to standard and modified triangular trihedrals where the panels 23 are formed in their entirety of a material assumed to have a coefficient of reflectivity of unity.

The maximum theoretical half power beamwidth of the triangular trihedrals described above is approximately ± 20 degrees about the reflector axis in both the azimuth and elevational plane.

In order to achieve the radar performance described above and still allow the passage of light energy, the three panels 23 of the reflector must be constructed substantially of a material that is transparent to light and which offers a high coefficient of reflection to radar wavelengths. The screen mesh material from which the radar reflector is formed may be stainless steel wire having a diameter of approximately .0045 inch with the mesh density being from approximately eight openings per inch. While this material is not the only material that may be used it has been measured in the reflector configuration at the desired radar frequency and found to be most satisfactory. This material also has a minimum shadow area to light and the brightly surfaced wire aids reflection. The reflectance of the material is determined by the following equation:

$$R = 20 \text{ Log } \frac{Z_w}{4Z_s}$$

where

R = reflection at normal incidence in db $Z_w$ = impedance of the wave at the reflector in ohms $Z_s$ = impedance of the reflector in ohms.

The $Z_w$ term becomes 377 ohms when the distance between the radar transmitter and reflector is greater than one wavelength, which greatly simplifies the equation for the intended application described herein. However, the $Z_s$ term can only be determined experimentally from a practical standpoint. The optimum screen properties can only be determined on an experimental basis. A rule of thumb can be employed as an approximation; this rule states that the openings in the mesh should be approximately one-tenth wavelength.

From the foregoing, it will be seen that I have devised an improved inline radar-visual augmentation system for airborne targets. By providing an inline arrangement wherein the radar reflector and the light source are mounted wholly within the confines of the target body with the reflector being so constructed and arranged that it is essentially transparent to light and reflective insofar as radar wavelengths are concerned, I provide means for enhancing the visual properties of the target and still provide a target which is reflective to radar wave lengths. Also, by providing a system wherein the light source and radar reflector are mounted wholly within the confines of the target body, I greatly reduce the overall cost of the target and at the same time I do not change the basic aerodynamic shape of the target, whereby the weight and aerodynamic drag of the target is reduced to a minimum.

While I have shown my invention in but one form, it will be obvious to those skilled in the art that it is not so limited, but is susceptible of various changes and modifications without departing from the spirit thereof.

What I claim is:

1. A system for augmenting the visual and radar characteristics of an airborne target in a common sector comprising, a. an elongated target body, b. a visible light source mounted in line within the confines of said target body and adapted to emit a beam of light axially of said body in at least one direction, c. a radar reflector mounted within the confines of said target body coaxially with and forwardly of said light source as viewed in the direction of travel of light from said light source so that said radar reflector is in the path of light propogating from said light source with said radar reflector being substantially transparent to light from said light source and reflective to radar wavelengths.

2. A system as defined in claim 1 in which said radar reflector is a metallic screen-like member of open mesh.

3. A system as defined in claim 2 in which said radarreflector comprises relatively flat screen-like members.

4. A system as defined in claim 2 in which said radar reflector is in the shape of a generally triangular trihedral.

5. A system as defined in claim 2 in which the mesh density of said screen-like member is approximately eight openings per inch.

6. A system as defined in claim 2 in which said screen-like member is formed of stainless steel wire of approximately .0045 inches in diameter.

7. A system as defined in claim 2 in which the openings in the mesh are approximately one-tenth radar wavelength.

8. A system as defined in claim 2 in which said light source and said radar reflector are mounted inline in a cylindrical portion of said body without changing the basic aerodynamic shape of the target.

9. A system as defined in claim 2 in which a turbine unit is mounted for rotation adjacent the rear of said target body and is operatively connected to an electrical generating unit which supplies power to said light source.

* * * * *